US009631368B1

(12) United States Patent
Heo

(10) Patent No.: US 9,631,368 B1
(45) Date of Patent: Apr. 25, 2017

(54) ROOFING END CAP AND METHOD OF USE

(71) Applicant: Bal Heo, Alpharetta, GA (US)

(72) Inventor: Bal Heo, Alpharetta, GA (US)

( * ) Notice: Subject to any disclaimer, the term of this patent is extended or adjusted under 35 U.S.C. 154(b) by 0 days.

(21) Appl. No.: 15/004,947

(22) Filed: Jan. 24, 2016

(51) Int. Cl.
*E04B 7/00* (2006.01)
*E04D 13/00* (2006.01)

(52) U.S. Cl.
CPC ..... *E04D 13/004* (2013.01)

(58) Field of Classification Search
CPC ..... E04D 13/004
USPC ..... 52/96, 57, 101, 198
See application file for complete search history.

(56) References Cited

U.S. PATENT DOCUMENTS 669,148 A * 3/1901 Smith ..... E04F 13/147 52/13
3,381,425 A 5/1968 Gobel
4,073,106 A 2/1978 Malott
4,233,786 A * 11/1980 Hildreth ..... E04D 13/1585 52/556
4,501,097 A 2/1985 Rosenkilde
4,558,637 A * 12/1985 Mason ..... E04D 1/3402 454/365
4,957,037 A * 9/1990 Tubbesing ..... F24F 7/02 454/366
4,965,976 A 10/1990 Riddle et al.
5,458,538 A * 10/1995 MacLeod ..... E04D 13/174 454/365
5,713,158 A * 2/1998 Gibbs ..... E04D 3/40 52/198
5,772,502 A * 6/1998 Smith ..... F24F 7/02 454/365
6,125,602 A * 10/2000 Freiborg ..... E04D 1/265 52/198
6,227,963 B1 * 5/2001 Headrick ..... F24F 7/02 454/365
6,277,024 B1 * 8/2001 Coulton ..... F24F 7/02 454/365
D451,204 S * 11/2001 Schlichting ..... D25/38.1
6,725,609 B2 * 4/2004 Freiborg ..... E04D 1/30 52/276
6,991,535 B2 * 1/2006 Ciepliski ..... E04D 13/176 454/365
7,662,037 B2 * 2/2010 Polston ..... E04D 13/174 454/365
7,814,715 B2 * 10/2010 Coulton ..... F24F 7/02 454/364
7,905,061 B2 * 3/2011 Kaiser ..... E04D 13/00 244/199.4
8,245,482 B2 * 8/2012 Grubka ..... E04D 1/20 454/365
8,322,089 B2 * 12/2012 Railkar ..... E04D 13/174 454/364
8,640,397 B2 * 2/2014 Donoho ..... A01M 29/32 52/101
D718,885 S * 12/2014 Derreumaux ..... D25/141
8,935,895 B2 * 1/2015 Mankowski ..... E04D 13/176 454/365

(Continued)

*Primary Examiner* — Basil Katcheves
(74) *Attorney, Agent, or Firm* — Deanna L. Baxam; BAXAM LAW GROUP, LLC

(57) ABSTRACT

An apparatus that provides a durable protective covering over portions of a roof peak, including a roof ridge. Also disclosed are methods of protecting the highest elevations at the intersections of roof panels from bird damage caused by roosting of bird pests.

14 Claims, 4 Drawing Sheets

(56) References Cited

U.S. PATENT DOCUMENTS

| | | | | |
|---|---|---|---|---|
| 9,175,480 | B1 * | 11/2015 | Polston | E04D 13/17 |
| 2003/0077999 | A1 * | 4/2003 | Mankowski | E04D 13/174<br>454/365 |
| 2004/0194423 | A1 * | 10/2004 | Payne | A01M 29/32<br>52/741.1 |
| 2006/0196130 | A1 * | 9/2006 | Mantyla | E04D 13/174<br>52/198 |
| 2008/0110106 | A1 * | 5/2008 | Holly | A01M 29/32<br>52/101 |
| 2010/0112932 | A1 * | 5/2010 | Grubka | E04D 13/174<br>454/365 |
| 2014/0357181 | A1 * | 12/2014 | Stouffer | E04D 13/174<br>454/367 |

* cited by examiner

ROOFING END CAP AND METHOD OF USE

TECHNICAL FIELD

The invention of this application relates to the field of roofing, in particular the protection of the ridges and edges of roofing panel joints at the intersections thereof. The invention further relates to apparatuses and methods for preventing the deterioration or erosion of shingled roofing because of avian or other environmental damage.

BACKGROUND

Roofing may be constructed of various materials, examples of which include asphalt shingles, composite shingles or panels, or metal panels. The roof is an expensive investment in residential or commercial construction, and roofing installations are expected to last for up to several decades. Because of its elevation and exposure, the roofs are susceptible to environmental damage from extreme weather conditions such as high winds, prolonged layering of ice, snow weight and hail. These elements cause the roofing materials to be eroded or to become dislodged at installation points and the seams so that the impermeability of the roof construction is breached, and the resulting ingress of water and pests becomes a further source of damage. Pest damage is another significant cause of roofing loss or early deterioration. In particular birds, as their habit, seek out elevated perches and often choose the eaves, i.e. the edges of a roof which overhang and project beyond the walls that form the sides of a building, and the peaks and ridges of the roof, which are the high points at the intersections of roofing panels on a pitched roof. While the birds use these points of elevation as perches, they also nibble on particles from the roof, for example pebbles of asphalt from the shingles. Eating small indigestible particles aids the birds' digestion. This bird behavior is ubiquitous and a major factor in the characterization of birds as pests by the construction industry. Their continued pecking at the edges of the eaves and ridges cause a gradual, premature deterioration of the roofing materials over time. In addition, the plucking away at these exposed areas of the roof can create openings through which birds and other pests can enter and create undesirable and unsanitary nests beneath the roof covering. Birds may also build nests that block ventilation systems within the building and also impede ventilation of the roof itself. The weight of droppings from birds nesting beneath a building roof can cause ceiling collapse. The presence of birds on the roof also increases the level of noise which may be a nuisance to building occupants. Further, bird droppings contain uric acid, and at a pH of from about 3 to 4.5, the acidity can eat through most roofing materials. The droppings also create an unsightly appearance on the roof surface.

The methods that have been used to deter bird roosting on sensitive roofing areas have involved using repellent structures and materials or limiting physical accessibility to the roof elevations. According to the International Association of Certified Home Inspectors, owners of commercial buildings, which can suffer extensive bird damage at great financial losses, have resorted to devices such as bird spikes which involve installing numerous metal wires or spikes close together to form a porcupine-like arrangement pointed wires that discourage bird landings. An electric low-voltage current may also be run through the wires. These are expensive methods as the wires and electrical systems are difficult and time-consuming to install, and the obvious appearance on the roofing profile, especially in the case of residential roofing, is undesirable. Alternatively, scare devices such as balloons or animal images or characters can for a while deter bird approach; however after a while the birds overcome their apprehension at the presence of a static figure. The deterrent effect is reduced and the problem resumes. Another deterrent method includes applying a repellent liquid or paste to the roofing surface. These methods will require continual reapplication for the deterrent effect to be persistent. The foregoing bird repellent systems require significant additional expense and their effect is not permanent.

There is therefore a need in the field of roofing materials and installation for apparatuses, materials and methods that prevent roosting of bird pests, or alternatively prevent the damaging effects of bird roosting on roofs. Preferably, the needed solution would provide a protective covering that is durable, impermeable and made of a material than cannot be nibbled away by the birds themselves or otherwise eroded or degraded over time by environmental exposure. Further, such a solution should desirably provide protection over all the outermost elements of eave and ridge edges at the high points of a roof to provide a passive protective covering against the damage from bird perching. Such a solution is presented by the apparatuses and methods of the present invention.

SUMMARY OF INVENTION

The invention comprises, in one aspect, a roofing end cap that provides a durable protective covering over the exposed edges of roof eaves and ridges of a roof. The cap in this respect covers all the materials that are otherwise left exposed and susceptible to bird perching, pecking and nibbling at the exposed ends of the highest points of pitched roofs. The roofing end cap comprises opposed side panels that are joined to form (i) an apex comprising an angle that corresponds to the angular configuration of the roof peak formed at the intersection of roofing panels, and (ii) a lower dimension defined by the distance between the lower edges of the side panels; wherein the joined side panels extend laterally from the apex to cover the roof peak and a portion of a roof ridge defined by the intersection of the roofing panels and the roof peak. The device further comprises a face plate comprised of dimensions that correspond to the angle of the apex and to the lower dimension.

In another aspect the invention comprises a method of preventing the deterioration of roofing materials by roosting birds by covering an end portion of the intersection of roofing panels that form a roof ridge or peak at the apex of a roof. The term "end portion" means the distal end of the ridge formed by the intersection of angularly pitched roofing panels which is not otherwise connected to another area of the roof, i.e. the exposed end, for example at the eaves or the very edges of the roof. The term "peak" means the highest, vertically oriented point formed by the intersection of the roofing panels of a roof structure. The cap in its various embodiments may be fitted to polygonal roof peaks of different configurations. The cap further covers the protruding corners of one or more roof peaks at various points of the roof, usually the highest points on which birds perch.

In yet another aspect, the invention is a method of preventing the deterioration of roofing materials by roosting birds comprising affixing a roofing end cap over an exposed portion of a roof ridge or a roof peak.

In another aspect the invention comprises a method of installing a roof comprising superimposing a roofing end cap over the layers of materials applied to a building structure to form a roof, thereby creating a protective covering over all the layers of the roof at the edges thereof.

DESCRIPTION OF EMBODIMENTS

There are typically about six angle configurations for peaked roofs that are included in bulk construction of housing. These include standard peak angles of 4°, 6°, 8° and 12°. In certain embodiments of the invention, the roofing end cap may have a pleated face plate that allows the angle of the peak to be adjusted to fit the particular angle and pitch of the roofing ridge over which the end cap is installed. The pleated face plate is accordion-folded so it can be expanded or contracted to decrease or increase the peak angle of the roofing end cap to match the peak angle of the roof. In this way the cap can be configured to fit a range of roof angles. In a preferred embodiment, the pleats are located at intervals across the face plate of the roofing end cap to correspond to the standard pleat angles. In this respect, contractors can use a single size of roofing end cap to cover a variety of roof angles. Alternatively, the end cap and face plate may be manufactured according to a predetermined angle and dimensions that do not allow for adjustment.

The roofing end cap may be configured as three joined panels, i.e. two side panels, joined each on side at an apex, which are together joined to a face plate. The face plate may be of fixed size or it may be made expandable by the inclusion of preset expansions that correspond to the standard roof angles. In other embodiments the face plate is flat, without pleating, and in this respect the roof end cap is configured to fit one predetermined roof peak angle. In other embodiments, the face plate may be composed of angled, planar segments designed to fit over roof peaks that have more than two sides forming the peak. In these embodiments, the planar segments of the face plate may be flat or pleated. In certain embodiments, the orientation of the face plate is vertical relative to the apex, however in other embodiments the face plate originates from the apex at an oblique angle.

Figure 1:
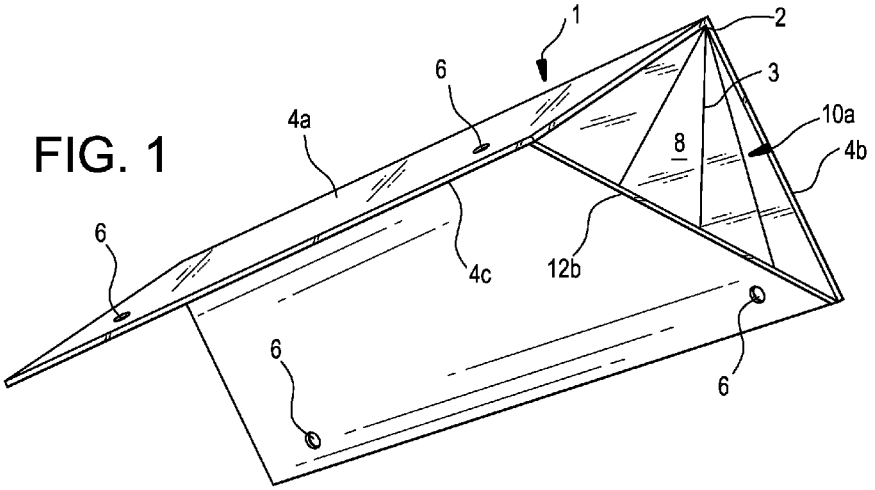
FIG. 1 is a perspective view of a roofing end cap according to an embodiment of the invention which has a grooved and pleated face plate.

As shown in the embodiment of FIG. 1, the roofing end cap 1 is comprised of side panels 4*a*, 4*b*, which are most preferably equivalent in length and width. Side panels 4*a*, 4*b* are connected at an apex 2 (FIG. 2) at an angle. (Generally, the angle at the apex may be an acute angle up to an oblique angle less than 180°.) Side edges 4*b* and lower edges 4*c* of the side panels beneath the apex define the dimensions of the face plate, the distance between the lower edges 4*c* further defining a lower dimension. The side panel height on either side of the apex, the apical angle and the lower dimension define the overall dimensions of the face plate 10*a*, which is joined to each side panel at one end of the roofing end cap 1. The side panels may be formed separately and joined together at the apex, for example by welding, or they may be formed by folding a single sheet of material along a roughly central fold or score line by that corresponds to the apex. The conjoined side panels are further joined, for example by welding, to the side edges of the face plate 10*a*.

Figure 2:
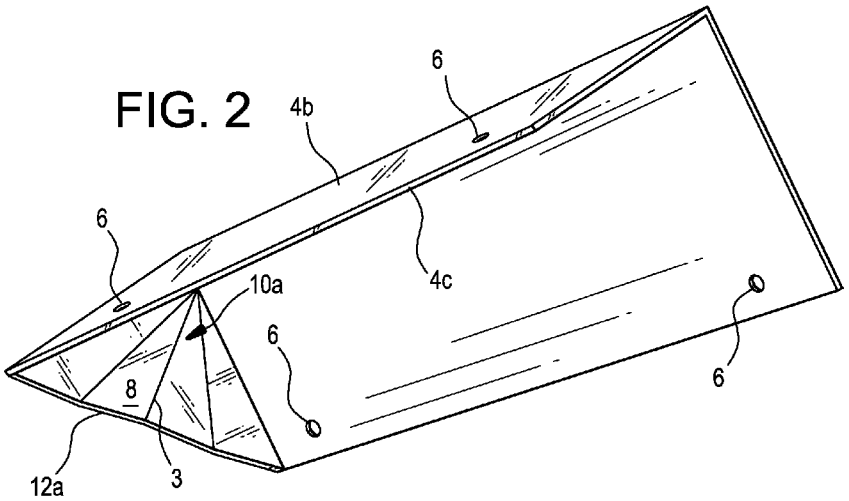
FIG. 2 is a perspective view from the underside of an embodiment of the roofing end cap which has a grooved and pleated face plate.
Figure 3:
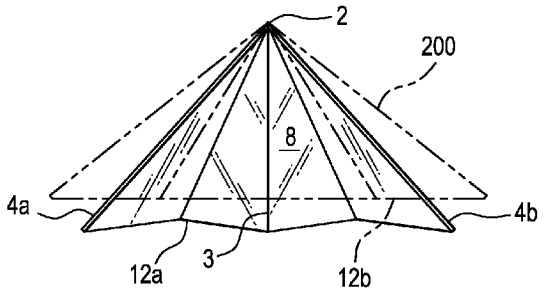
FIG. 3 is a planar view of the face plate of a roofing end cap according to the invention which is extendable to a wider angle in an alternate elevation.
Figure 4:
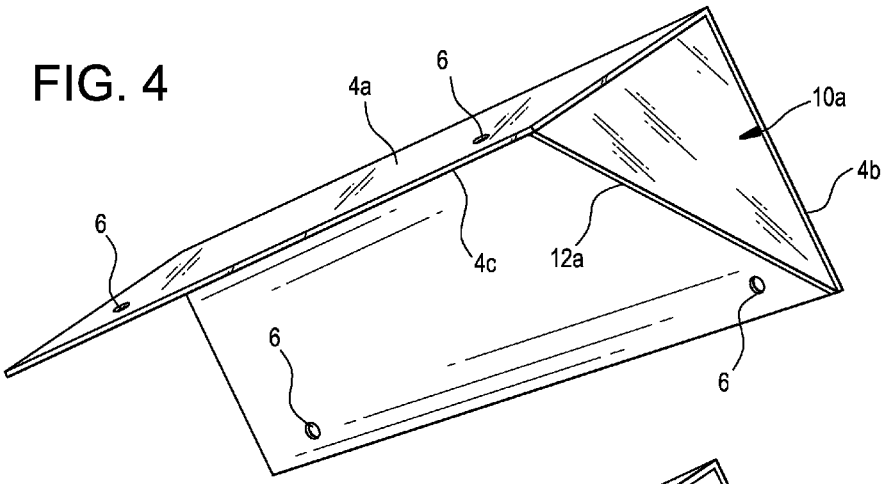
FIG. 4 is a perspective view of a roofing end cap with a flat, non-expandable face plate according to an embodiment of the invention.

According to FIG. 1, the face plate 10*a* is divided by angularly disposed grooves 3 which divide the face plate into smaller triangular segments 8. The grooves 3 serve as fold lines along which the face plate 10*a* may be folded or pleated in accordion-like fashion to reduce the lower dimension, in this case the base width, of the face plate at lower edge 12*a*, as well as the size of the apex angle. This pleating may be broadened or contracted by pulling apart the side panels to permit the roofing end cap to be fitted and installed over multiple roof ridges of different angular pitch. Thus, in various embodiments of the invention, the face plate is a movable element that is resized by pleating to enable one device to provide a range of dimensions for universal application to various roof dimensions. In other embodiments, for example as seen in FIG. 4, the face plate 10*b* is a flat panel without grooves and it has a fixed base width; and accordingly, the apex angle dimensions are also fixed. In FIG. 1, the face plate 10*a* is fully extended to its maximum breadth, and as a result the lower edge 12*b* is substantially linear. FIG. 2 is a perspective view of a roofing end cap from the end opposite the face plate. In this view, the face plate is partially contracted, the pleats not being fully extended, and as a result the face plate has a non-linear lower edge 12*a*. The operation of the face plate is further demonstrated in FIG. 3. In this representation, the face plate 10*a* is folded along each groove 3, alternating the direction of plate segments 8 about the fold line to form accordion-like pleats, all emanating from the apex 2. When the pleats are not fully extended or stretched apart, the lower edge 12*a* exhibits a similar pleating. As further shown in FIG. 3, the pleated panels may be stretched or expanded to eliminate the pleating and form a flattened face plate 200 having a wider apex angle which in turn enables the roofing end cap to be fit over a roof peak having a lesser pitch, i.e. a wider angle at the intersection of roofing panels that form the ridge. As seen in FIG. 1 and also in FIG. 4, the orientation of the face plate in relation to the side panels is substantially vertical, so that the end cap has the shape and appearance of an open-ended triangular tube when it is installed on the roof.

Figure 5:
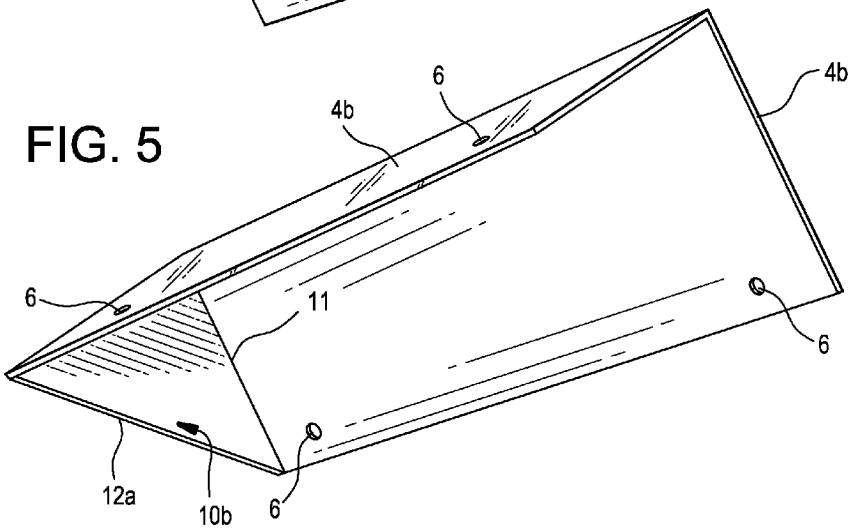
FIG. 5 is a perspective view of the underside of an embodiment of the invention.

In the embodiment of FIG. 4, the roofing end cap is comprised of a face plate having fixed dimensions in which the pleating is absent. FIG. 5 is a perspective view of the device from the end opposite the face plate. As can be seen from these representative drawings, the outer exposed surface of the end cap 1 is typically smooth and is preferably made of an impervious material, such as metal. The underside of the device may not necessarily be smooth, as a high degree of finishing is not required.

Figure 6:
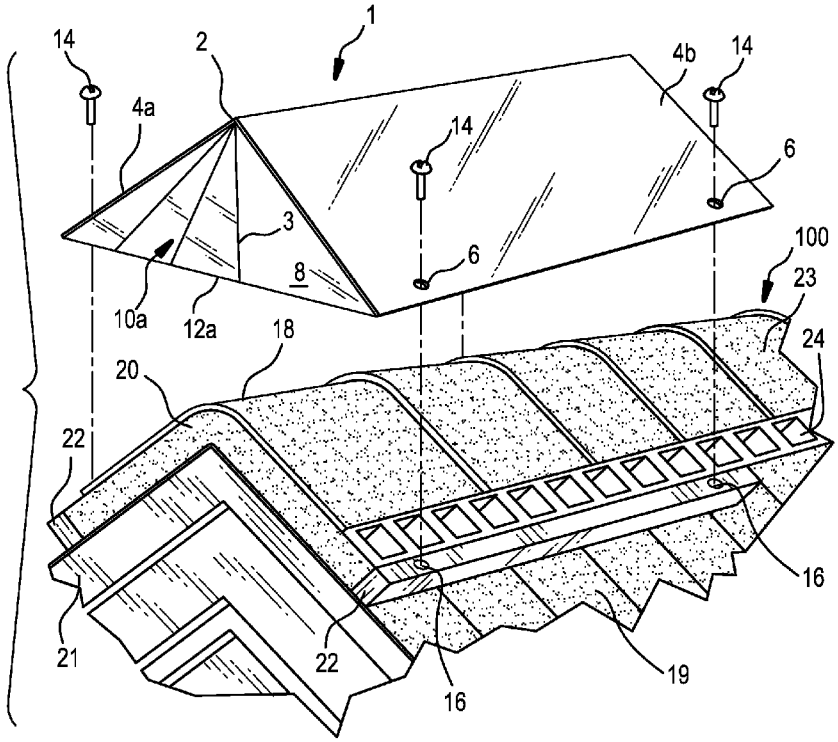
FIG. 6 is an exploded view of a roofing end cap attachable over a roof peak of a building structure.
Figure 7:
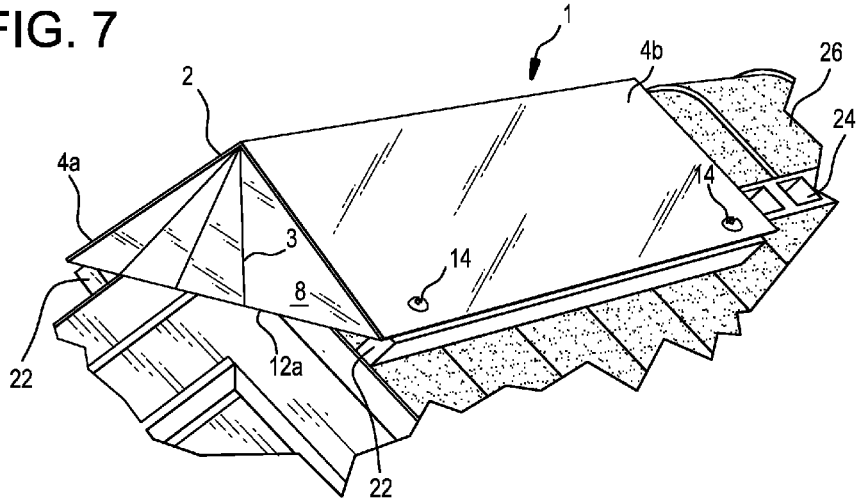
FIG. 7 is a perspective view of a roofing end cap fully attached to a roof structure.

The side panels 4*a*, 4*b* may include attachment means for connecting the roofing end cap to a roof structure. As shown in FIGS. 1 and 2, the side panels include holes 6 for receiving nut and bolt attachment means. The type and number of attachment means is not limited and may be selected from any type or number that can be identified by a person of ordinary skill in the art. In the embodiments of FIGS. 6 and 7, the roofing end cap 1 is attached to a roof structure 100 by attachment of bolts 14 through the side panels 4*a*, 4*b* to receiver means 16 located in one or more brackets 22 attached to the roofing surface. The brackets 22 are attached to the roof 100 to prevent damage to the roofing materials, e.g. ridge vents that are usually affixed over the intersection of the roofing panels, by nails or bolts. The roofing end cap may be attached to the roof structure by any other known means, such as adhesive panels, clips or staples.

As seen in FIG. 6, the underlying roofing structure 100 may typically be composed of framing with outer edges 21 over which is installed framing boards (not shown), which are topped by roofing shingles 19. The device of the invention is designed for use primarily with asphalt roofs, in which the shingles are made from asphalt or composites, as these have the most practical need for protection from bird damage. However, the device may be installed over other types of roofing, such as clay tile roofs or metal roofs for equally practical effect or as a decorative element. The side panels and the face plate may also include decorative features such as carving, small cutouts, scroll work and metal finishes such as high gloss, satin or hammered metal finishes. The end cap may also be colored to match the roof color or a contrasting color.

The invention also functions by covering and protecting the edges of a conventional ridge vent when it is installed along the ridge of on an asphalt or composite shingled roof. In an A-frame roof, the intersection between angularly connected roofing panels is often covered by an elongated ridge vent 20 that runs the length of the roof ridge. The purpose of the ridge vent (also referred to as an attic vent) is to allow hot air to be ventilated from beneath the roof to prevent swelling of the joints and dislocation of the shingles. An exemplary ridge vent is the COBRA® Exhaust Vent for Roof Ridges, which is manufactured by GAF (see, e.g. U.S. Pat. No. 5,772,502). Like asphalt roofing shingles, the ridge vent is also susceptible to bird damage because birds are attracted to the particulate material in the asphalt material used to form the vent. The device of the invention may be used without or without the installation of an underlying ridge vent. When the ridge vent is present, the roofing end cap desirably covers the ends of the ridge vent which are otherwise exposed at the end of the roof ridge near the eaves. By covering the ridge vent, a more uniform appearance of the roof profile is achieved without any unsightly asphalt ridge vent material showing at the roof edges. As shown in FIG. 6, the ridge vent 20 is formed from asphalt material 23 which is positioned over the intersection of the roofing panels and vented by a series of gaps 24 along each side of the vent. In this regard, it is not desirable that the roofing end cap entirely cover the gaps 24. Accordingly, the end cap is not installed flush with the asphalt material 23, but rather the side edges 4*c* of the end cap are affixed to receiving means such as mounting brackets 22 installed on either side of the ridge vent 20 (FIG. 7). Attachment devices other than brackets may be used, provided they allow for attachment of the roofing end cap without blocking the air flow exhausted through the ridge vent, and further without damage to the ridge vent or the underlying roof materials. For example, flanges may be installed on the roof structure instead of brackets to provide a surface for attachment of the end cap. Whatever the means of its foundation or anchoring, the device of the invention is installed in a manner that does not interfere with the function of the ridge vent. Rather, in roofs in which a ridge vent is used the roofing end cap is installed over the ridge vent as well as over the other roofing materials. When in place, the lower edge 12*a* of the end cap 1 hangs over the edge of the roof structure and covers at least a part of the face of the roof. The typical length of the end cap is typically no more than 2 feet, preferably from about 1 to 2 feet in length. The depth of the cap from the peak 2 to the lower edge 12*a* may range from about 6 inches to as much as 24 inches, depending on the dimensions of the roof peak. It should be noted that these dimensions may be further increased or decreased as needed so that the end cap may properly fit over the exposed edges of the roof ridge and a portion of the length of the roof ridge proceeding distally from the edge. In this respect the end cap will cover a portion of the roof ridge but not its entire length.

Figure 8:
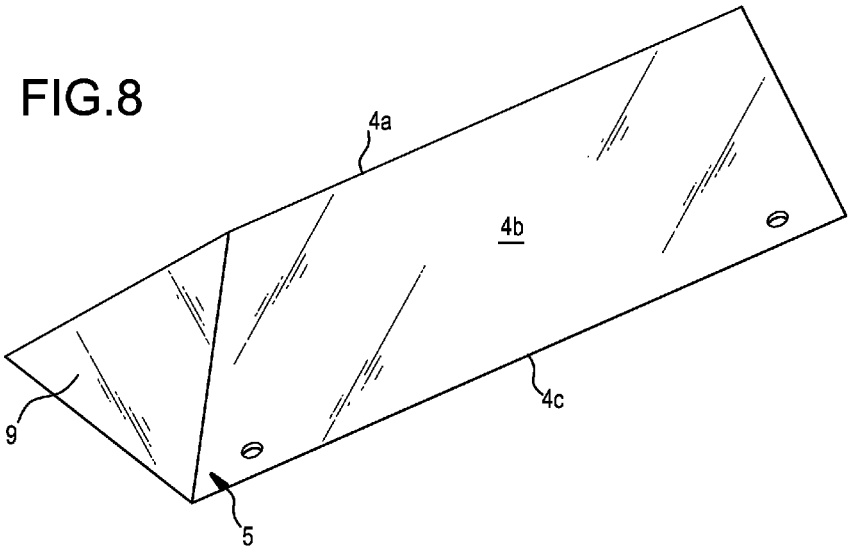
FIG. 8 is a perspective view of a roofing end cap having an obliquely angled face plate according to a further embodiment of the invention.

In certain other embodiments of the invention, the roof peak may not accommodate an end cap having a flat face plate. For example, some roofs have peaks that do not reach the edge of the roof but rather they are features of the internal expanse of the roof. In such cases, the face plate is modified to fit over an angled third panel. That is, the peak may be composed of three panels each of which is obliquely angled in relation to the apex. The embodiment shown in FIG. 8 shows an end cap having side panels in which the front lower edge 4*c* is of greater length than the upper edge 4*d*. The difference in length creates a protrusion 5 at the front edge of each side panel, to which an obliquely positioned face plate 9 is attached. The resulting end cap thus can be more pyramidal or polygonal in structure at the closed end. Other roof peaks that may have even multiple panels joined at a single peak, such as may be found in octagonal turret peaks, may also be capped using variations of the invention which have an increased number of opposing side panels and face plates as described herein. In this respect, the invention is contemplated to cover roofs of different shapes and peaks having multiple panels joined together at a range of angles.

The roofing end caps of the invention formed from impermeable and durable material that is resistant to bird erosion. Preferred materials are metals or other rigid, durable and sheeted or molded materials, for example polyvinyl chloride (PVC). The material may be of differing colors, textures, gloss or matte finishes as may be desired to render the end cap compatible with the roof upon which it is installed. It may also include additional ornamentation such as embossing, perforations, carved elements, shapes or patterns. The end cap may be formed as separate parts and welded together, for example if the construction is of metal, or it may be molded, for example by thermoforming, cast-molding or three-dimensional printing if the construction is of a polymeric material. These forming methods are not limited, and any other form of construction which may be envisioned by a person of ordinary skill in the art may be employed.

The methods of the invention for preventing the deterioration of roofing materials by the activity of roosting birds comprises measuring the angle at the intersection of roofing panels that form a roof ridge at a heightened elevation of a roof; measuring the one or more angles at the intersection of roofing panels that form a roof peak; adjusting the angular dimensions of a roofing end cap according to the aforementioned description to an angle that corresponds to the dimensions of the angle of the intersected roofing panels; and affixing the roofing end cap over an exposed end portion of the roof ridge and the roof peak to provide a permanent covering over the roof peak and portions of the roof ridge. Measurement of the angle to which the cap should be adjusted may be accomplished by a visual estimation by one of ordinary skill in the art, and the adjustment itself should be done by manual pulling or compressing of the ends of the face plate. The adjusted cap can be installed as otherwise described herein. In the method of installing a peaked building roof using the device of the inventive concept, the roofing end cap is installed over the roofing materials applied to the surface of the roof structure such that it is the outermost element in relation to the other layers of roofing material applied to the roof frame.

INDUSTRIAL APPLICABILITY

The various embodiments of the invention may be used as a protective element on residential or commercial roofing structures. Multiple end caps may be used on a single building. The foregoing specification and examples provide an enabling description of the method of manufacture and comestible products of the invention. Many embodiments can be made without departing from the spirit and scope of the invention and this disclosure, including those represented by the appended claims.

The invention claimed is:

1. A roofing end cap system that provides a durable protective covering over portions of a roof peak and roof ridge, comprising:

a. A roof portion of a roof, wherein said roof portion includes roofing panels having upper edges joined at an angle to form a roof ridge, the upper edges of said roofing panels forming a roof peak;

b. a building structure atop which the roof portion is installed, which includes a side wall perpendicular to and beneath the roof peak; and c. a roofing end cap that includes:

two opposed, rectangular side panels, each side panel comprising an upper edge, a lower edge and a first and second side edge, and one side panel is joined to the other side panel at their upper edges at said angle; further, wherein a distance between the lower edges of the side panels forms a lower dimension; and a face plate attached to each of the two opposed, rectangular side panels at the first side edges thereof, wherein the face plate comprises an upper point and a lower edge having ends opposite the upper point that is of a width equal to the lower dimension, the distance between the upper point and the lower edge ends being a same length as the side edges, wherein the face plate covers and hangs below the roof peak and overlaps and overhangs the side wall of the building structure.

2. The roofing end cap of claim 1 wherein the face plate comprises two or more foldable pleat segments separated by a plurality of angularly disposed lines of weakness along which the face plate is folded, said lines of weakness radiating from the upper point to the lower edge of the face plate, and further wherein the foldable pleat segments are folded along said lines of weakness to reduce the angle formed by the side panels of the roofing end cap, and the width of the lower edge of the face plate is extended to increase the angle formed by the side panels of the roofing end cap.

3. The roofing end cap of claim 2 wherein the lines of weakness fold the face plate into pleat segments that extend or contract the angle of the apex formed by the side panels of the roofing end cap to standard roof peak angles of 4°, 6°, 8° or 12°.

4. The roofing end cap of claim 1 further comprising attachment means for affixing the roofing end cap to a roof surface.

5. The roofing end cap of claim 4 wherein the attachment means are pre-cut holes in the side panels that accommodate bolts.

6. The roofing end cap of claim 4, wherein the attachment means are areas for stapling or nailing the roofing end cap to the roof portion.

7. The roofing end cap of claim 1 constructed from a rigid, durable sheet material.

8. The roofing end cap of claim 7 wherein the material is selected from metal, polyvinyl chloride (PVC) or other rigid, durable and impermeable material.

9. A method of preventing the deterioration of roofing materials by roosting birds comprising:

a. measuring the angle at an intersection of roofing panels that form a roof ridge at a heightened elevation of a roof of a building structure, said building structure comprised of side walls beneath and perpendicular to a roof peak;

b. measuring said angle at the edge of the roof peak defined by the edge of the roof ridge, c. providing a roofing end cap comprised of two opposed, rectangular side panels, each side panel comprising an upper edge, a lower edge and a first and second side edge, and each one side panel is joined to the other side panel at their upper edges thereof at said angle; further, wherein a distance between the lower edges of the side panels forms a lower dimension; and a face plate attached to each of the two opposed, rectangular side panels at the first side edges thereof, wherein the face plate comprises an upper point and a lower edge having ends opposite the upper point that is of a width equal to the lower dimension, the distance between the upper point and the lower edge ends being a same length as the side edges, and d. affixing the roofing end cap over the roof peak and a portion of the roof ridge such that said length of the face plate covers and hangs below a portion of the edge of the roof peak and overlaps the side wall of the building structure beneath the roof peak;

wherein the installed roofing end cap protects the roof peak and portion of the roof ridge covered thereby from damage by roosting birds.

10. The method of claim 9 wherein the face plate further comprises a plurality of angularly disposed lines of weakness, each radiating from the upper point of the face plate to the lower edge of the face plate; and the step of adjusting the angular dimensions of the roofing end cap comprises folding the face plate along one or more of the lines of weakness to reduce the width of the lower edge to reduce the angle formed by the side panels of the roofing end cap, or by extending the width of the lower edge of the face plate to increase the angle-formed by the side panels of the roofing end cap.

11. The method of claim 10 wherein the roofing end cap is superimposed over the edge of the roof peak and a portion of a ridge vent is installed over the roof ridge.

12. The method of claim 9 wherein the roofing end cap is affixed over a portion of the roof ridge and the roof peak by attaching it to a bracket or receiving means attached to the roof.

13. The method of claim 9 wherein the roofing end cap is comprised of metal, polyvinyl chloride (PVC) or other rigid, durable sheet materials.

14. The method of claim 9 wherein the roofing end cap is superimposed over the edge of the roof peak and a portion of a ridge vent is installed over the roof ridge.

* * * * *